United States Patent [19]

Iturrey, Jr.

[11] Patent Number: 5,040,322

[45] Date of Patent: Aug. 20, 1991

[54] NIGHT SHOOTING AID

[75] Inventor: Juan A. Iturrey, Jr., Elizabeth, N.J.

[73] Assignees: Juan A. Iturrey, Sr.; Maria Iturrey, both of Elizabeth, N.J.

[21] Appl. No.: 562,679

[22] Filed: Aug. 3, 1990

[51] Int. Cl.[5] ..... F41G 1/35

[52] U.S. Cl. ..... 42/103; 362/110

[58] Field of Search ..... 42/103, 106; 362/110, 362/111, 112, 113, 114

[56] References Cited

U.S. PATENT DOCUMENTS

| | | | |
|---|---|---|---|
| 784,227 | 3/1905 | Riblet | 362/114 |
| 957,299 | 5/1910 | Barnes | 362/110 |
| 1,263,667 | 4/1918 | Henderson et al. | 362/114 |
| 1,452,651 | 4/1923 | Norrlin | 362/110 |
| 1,610,092 | 12/1926 | Hise | 362/110 |
| 1,826,004 | 10/1931 | Key | 362/110 |
| 1,993,979 | 3/1935 | Reed | 362/113 |
| 2,017,585 | 10/1935 | Casey | 362/114 |
| 2,128,526 | 8/1938 | Eslick | 362/110 |
| 2,209,524 | 7/1940 | Key | 42/103 |
| 2,314,061 | 3/1943 | Whaley | 362/110 |
| 2,450,584 | 10/1948 | Dodge | 362/114 |
| 3,222,511 | 12/1965 | Breeding | 362/110 |
| 4,079,534 | 3/1978 | Snyder | 42/103 |
| 4,161,076 | 7/1979 | Snyder | 42/103 |
| 4,168,588 | 9/1979 | Snyder | 42/103 |
| 4,313,272 | 2/1982 | Matthews | 42/103 |
| 4,313,273 | 2/1982 | Matthews et al. | 42/103 |
| 4,348,716 | 9/1982 | Storm et al. | 362/110 |
| 4,418,487 | 12/1983 | Strahan | 42/101 |
| 4,542,447 | 9/1985 | Quakenbush | 42/103 |
| 4,697,226 | 9/1987 | Verdin | 362/110 |
| 4,758,933 | 7/1988 | Winberg et al. | 362/110 |
| 4,777,754 | 10/1988 | Reynolds, Jr. | 42/103 |
| 4,894,941 | 1/1990 | Karow | 42/103 |

*Primary Examiner*—Michael J. Carone

*Attorney, Agent, or Firm*—Julian C. Renfro

[57] ABSTRACT

A night shooting aid which provides the user with the ability to shoot accurately in a low light environment. It comprises a structural device having a flashlight-engaging member along one edge, and a weapon-retaining member along the opposite edge, at a laterally removed location from the flashlight-engaging member. In this way a flashlight and a weapon supported by the structural device can be aimed in a common direction. The arrangement is such that the aim of the weapon is coincident with the aim of the flashlight at twelve to eighteen feet in front of the user. Two different embodiments of the weapon retaining member are disclosed for engagement with either a revolver or a semiautomatic weapon. A further feature of indentations on the underside of the device is also disclosed which adds stability to the device.

16 Claims, 3 Drawing Sheets

FIG 2
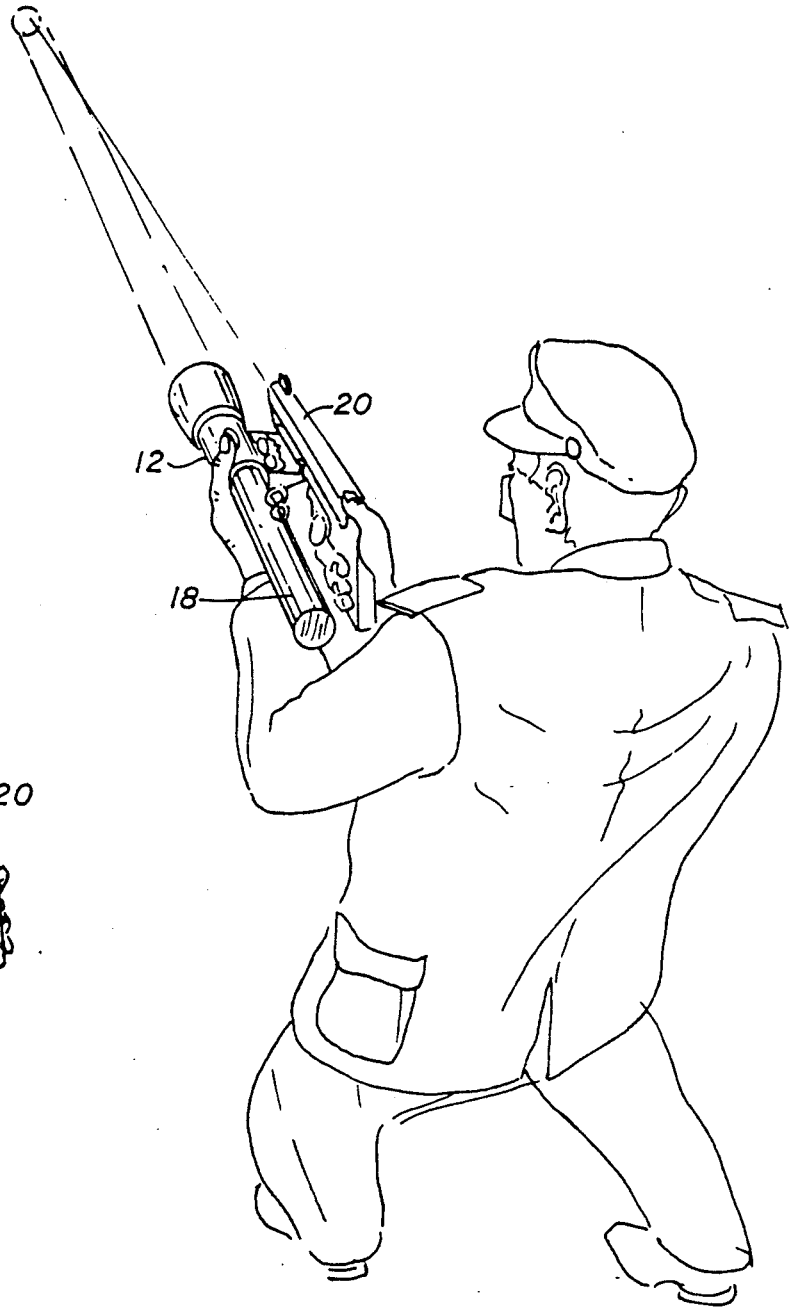
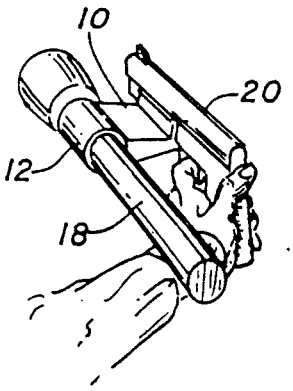
FIG 3
FIG 4
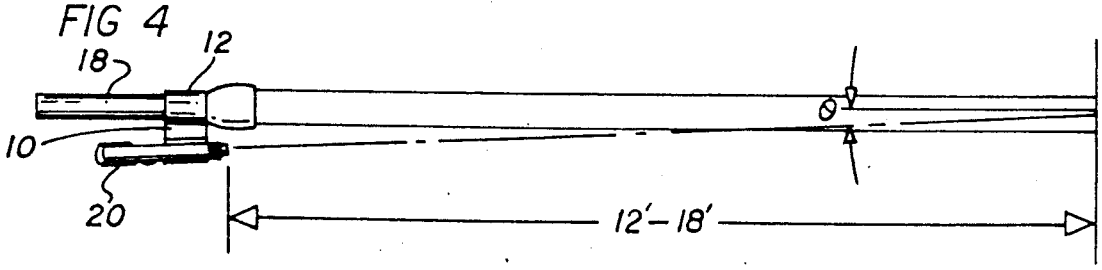

NIGHT SHOOTING AID

BACKGROUND OF THE INVENTION

1. Field of the Invention

The subject invention relates to firearms and, more specifically, to apparatus for assisting the aiming of firearms, and in particular to an apparatus of minimal expense to be utilized at night with a flashlight for assisting the aiming of a handgun with a light beam.

2. Disclosure Statement

For over eighty years, proposals have been made for assisting the aiming of firearms with light beams or light spots on targets. Reference may for instance, be had to U.S. Pat. Nos. 689,547, 894,306, 1,149,705, 1,452,651, 1,826,004, 1,993,979, 2,017,585, 2,844,710 and 2,912,566, proposing clamping a flashlight or incandescent lamp with lens, reflector arrangement and on-off switch or trigger switch and external or internal battery to a handgun, and U.S. Pat. Nos. 3,010,019 and 3,974,585, British Patent No. 5029, Swiss Patent Nos. 29,708 and 66,753, French Patent No. 1,015,421, and German Patent Publication No. 1,926,337, which also propose employment of electric incandescent lamps for providing aiming marks on firearm targets or on an optical sight.

Further proposals were spawned by the development of laser diodes comparable in size and ruggedness to small incandescent light bulbs as may be seen from U.S. Pat. No. 3,867,764. The utility of laser diodes as aiming devices was, however generally limited to marksmanship trainer, boresight alignment, weapon simulator and similar applications, as may, for instance, be seen from U.S. Pat. Nos. 3,633,285, 3,782,832, 3,898,747, 3,938,262 and 3,995,376. An infrared-light hit indicator apparatus is apparent from U.S. Pat. No. 3,104,478, and an electronic target game from U.S. Pat. No. 3,294,401.

Further references include U.S. Pat. Nos. 1,427,042, 2,085,732 and 2,597,565 disclosing methods of completing the electric circuit when the flashlight element is added, U.S Pat. No. 2,209,524 showing flashlight holders engaging a recess in a flashlight body or providing a transverse pin between spaced pistol grip bars for flashlight mounting purposes, U.S. Pat. No. 2,314,061 disclosing a tongue-type flashlight mounting, U.S. Pat. No. 2,450,584 for flashlight attachment for small arms, U.S. Pat. Nos. 3,222,511 and 4,542,447 showing dual switching means, and mounting systems for flashlights on firearms, and U.S. Pat. No. 3,739,167 disclosing also remote switching means for firearm-mounted lighting units.

Advanced laser beam aim assistance systems have been disclosed in U.S. Pat. Nos. 4,313,272 and 273. While these systems perform excellently, they naturally are rather expensive and therefore beyond the reach of many police departments or citizens.

It therefore became the goal of this invention to provide a simple yet highly effective night shooting aid or device normally residing on a flashlight of the type used by many police departments, which device is configured to receive a handgun or other such weapon, that is to be quickly inserted on a clip member located on the device only when contact with a felon is likely.

SUMMARY OF THE INVENTION

A night shooting aid in accordance with this invention provides the user with the ability to shoot accurately in an environment of low natural light. It comprises a structural device having a flashlight-engaging member along one edge, and a weapon-retaining member along the opposite edge, at a laterally removed location from the flashlight-engaging member. In this way a flashlight and a weapon supported by the structural device can readily be aimed in a common direction.

The flashlight-engaging member is of generally tubular configuration, and has an inner diameter only slightly larger than the outer diameter of a flashlight to be used with the structural device. The weapon-engaging member takes the form of an elongate clip member having its uppermost edge upward, with the sidewalls of the clip member angling upward so as to be closer together at the top than at the bottom. Thus, when forced apart, the sidewalls of the clip member receive and tightly engage a forward portion of the weapon. In accordance with this invention, the structural device is usually maintained with a flashlight inserted into the flashlight-engaging member of generally tubular configuration. The user is thus able to quickly insert a handgun into the handgun-retaining member when commencing an activity at low light level, such that the user is enabled to confirm the presence of a felon at night before pulling the trigger of the hand-weapon.

The weapon-receiving clip, has upwardly extending sidewalls that are closer together at the top than at the bottom. The clip member is of a resilient material such that the sidewalls strongly resist separation. Therefore, upon the clip sidewalls being forced apart to receive a forward portion of a weapon therein, they, upon release, tightly grip the weapon, and serve to direct the aim of the weapon to a point of coincidence with the aim of the flashlight.

It is therefore a primary object of this invention to provide a night shooting aid of low cost, enabling the user to achieve great accuracy at night with a handgun, at a distance of approximately fifteen feet.

It is another object of this invention to provide a night shooting aid of simple and effective construction, that provides a user with the ability to achieve extreme accuracy in a night-fire situation.

It is still another object of this invention to provide a night shooting aid that can be more or less continuously maintained on a standard size flashlight without inhibiting the normal use of the flashlight when a handgun is not being used therewith.

It is yet another object of this invention to provide a night shooting aid of a configuration such that it can quickly receive various types of handguns without necessitating an adjustment of any kind to the weapon retainer.

It is yet still another object of this invention to provide a night shooting aid or weapon retainer that enhances the chance of a law officer dealing with a felon getting off the first accurate shot in a night-fire situation, where the officer's life is in jeopardy and deadly force is called for.

It is yet still another object of this invention to provide a night shooting aid whose use involves no compromise to the construction or operation of either the handgun or the flashlight.

It is yet still another object to provide a night shooting aid that will assist in the ejection of spent rounds and chambering of live rounds by providing a firm grip of the weapon's frame thus decreasing the resistance required for proper ejection and chambering.

It is yet still another object to provide a night shooting aid whose unique construction is such as to make possible the utilization of multiple weapons of different dimensions and caliber.

BRIEF DESCRIPTION OF DRAWINGS

FIG. 2 is a perspective view of a law enforcement officer utilizing my invention in a typical manner;

FIG. 3 is a fragmentary view, to a smaller scale, indicating an optional manner in which the handgun may be grasped;

FIG. 4 is a view from above of the typical positioning of the flashlight and the handgun, showing how the beam from the flashlight may converge with the line of fire from the handgun at a distance of twelve to eighteen feet;

DETAILED DESCRIPTION

Figure 1:
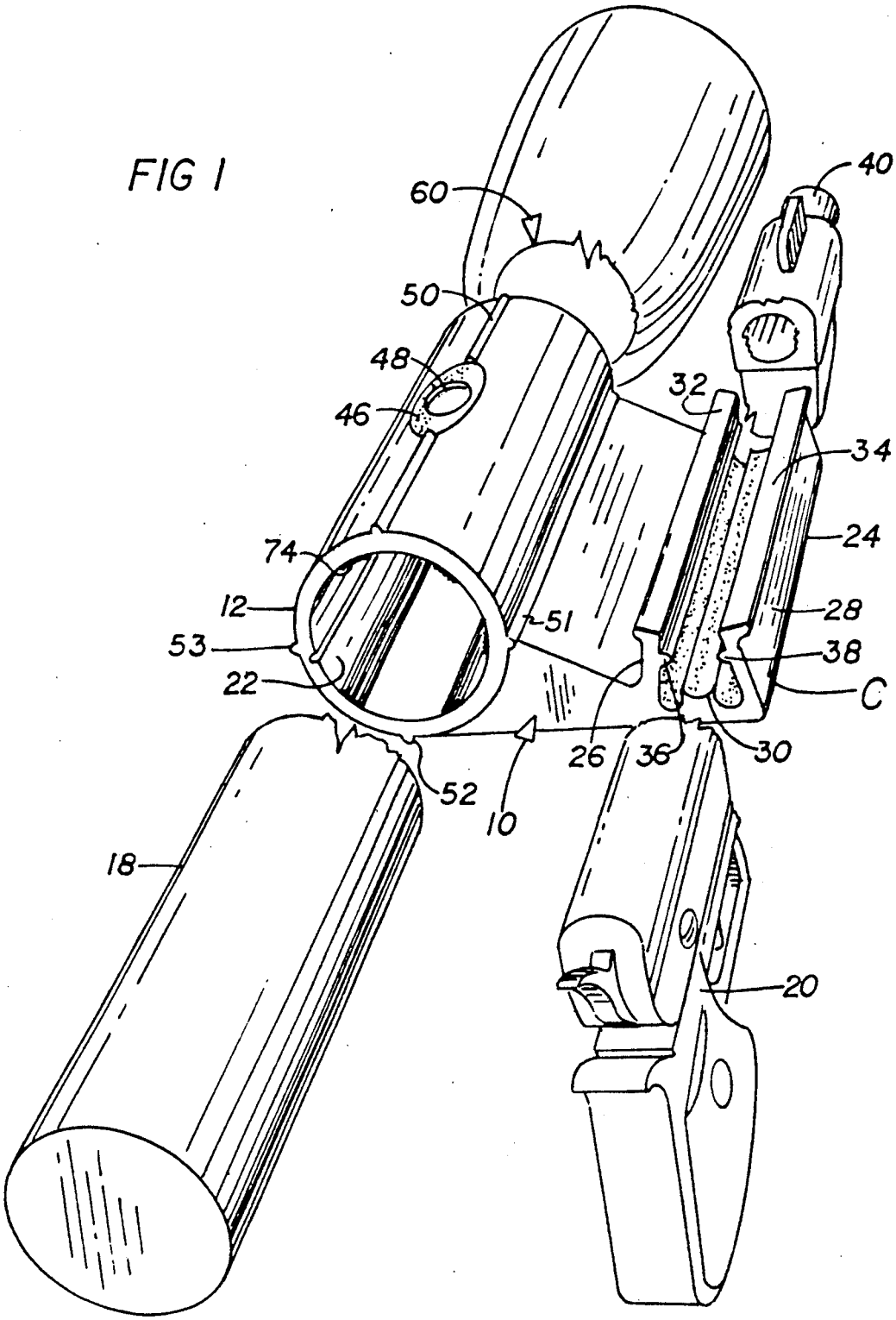
FIG. 1 is a perspective view of a preferred embodiment of a Night Shooting Aid in accordance with this invention, in conjunction with which are fragmentary portions of the flashlight and the handgun used therewith.

With initial reference to FIG. 1, it will there be seen that I have illustrated a preferred embodiment of a Night Shooting Aid in accordance with this invention, which enables the user to confirm the presence of a felon at night before pulling the trigger of a hand-weapon. It comprises a mounting device or structural member 10 configured to receive a flashlight as well as a hand weapon. This novel mounting device has a flashlight-receiving portion 12 on one edge, and a weapon-receiving member or clip C on the opposite edge of the device, both disposed to point essentially in a common direction.

The flashlight-receiving portion 12 is in the form of a generally cylindrically shaped member having a circular aperture 22 with an inner diameter only slightly larger than the flashlight 18 to be received therein.

The weapon-receiving member, generically referred to as clip C, is in the form of one or the other of two closely related clips, discussed in detail hereinafter, each of which is laterally spaced from the respective flashlight-receiving portion 12. In the instance of clip 24, depicted in FIGS. 1 and 5*a*, the clip has upwardly extending, elongate sidewalls 26 and 28 of resilient material, that are closer together at the top than at the bottom, thus to form a clip member whose sidewalls strongly resist separation. The uppermost edges 32 and 34 of the clip member 24 are rounded so as to readily receive a forward structural portion of the weapon. Therefore, upon the clip sidewalls 26 and 28 being forced apart to receive a forward portion of a weapon therein, they, upon release, tightly grip the weapon, and serve to direct the aim of the weapon to a point of coincidence with the aim of the flashlight. In the present instance the point of coincidence is in the range of 12 feet to 18 feet in front of the user.

This arrangement is such that the user can advantageously maintain the structural device 10 in place on his flashlight 18 while the flashlight is being utilized in routine matters, but when it is desired to be ready to engage a target, the user can quickly insert the handgun 20 into the location between the uppermost edges 32 and 34 of the handgun-retaining portion or member 24, so that a forward part of the handgun can tightly reside at a location between the left side 26 and right side 28 of the clip member 24. Importantly, alignment of the handgun aim with the aim point of the flashlight is automatically achieved. FIG. 2 illustrates the manner in which the typical user may utilize my device.

Figure 5A:
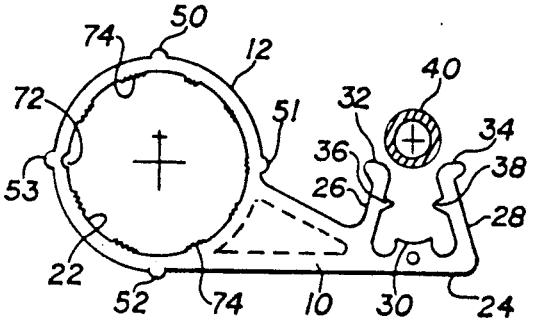
FIG. 5*a* is a cross-sectional view of a preferred embodiment of my novel device when being used with a handgun of the semi-automatic type.

As will be more apparent from the embodiment shown in FIG. 5*a*, in the event the weapon is a pistol in the nature of a semi-automatic, the forward structural portion of the weapon will reside between the sides 26 and 28 of the clip member 24, and rest against the bottom inner portion 30 of the clip member. This forms a tight and stable support for the semi-automatic type of handgun, with the clip member 24 being generally parallel to the circular aperture 22 in the flashlight-engaging member 12 However, as will be discussed in conjunction with FIG. 4, the flashlight-receiving portion 12 may not be precisely parallel to the clip or weapon-receiving member C whether it be the clip member 24 utilized with a semi-automatic pistol or hand weapon, or the clip member 54, depicted in FIG. 5*b*, that is intended for use with the barrel of a hand weapon such as a revolver. Rather, the handgun-retaining member C may be configured and arranged so that a bullet fired from the weapon will coincide with the beam or spot from the flashlight at a desired distance forward of the flashlight, which point of coincidence of flashlight beam and line of fire being twelve feet to eighteen feet forward of the flashlight lens. Fifteen feet is usually the desired distance of coincidence or coming together of these aim points.

One of the important aspects of my invention is the ability of my device to be utilized without the weapon in place during the time the flashlight is being used for customary nighttime activities, thus involving no serious compromise to the use of the flashlight for its intended purpose.

When, however, the need for use of the weapon becomes apparent, the user can quickly and easily insert the forward portion of the weapon frame between the sides 26 and 28 of the clip member 24, with the clip member 24 of the structural device 10 then serving to hold the weapon 20 in a predictable and accurate relationship to the flashlight. Because of this, the user can shoot with extreme accuracy in a night fire situation, with no effort being required insofar as concerns the setup of the weapon 20 in a desirable relationship to the flashlight.

The structural member 10 can be made of a wide range of suitable materials, both metallic and non-metallic, but in each instance it is made of very durable material such that the device may be used and re-used for a number of times.

Figure 5B:
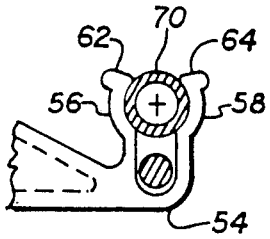
FIG. 5*b* is a fragmentary view of the device shown in FIG. 5*a*, but with the clip member of the device being of a type to receive the end portion of the barrel of a revolver.

From a comparison of FIG. 5*a* with FIG. 5*b*, it will be noted that whereas the embodiment of FIG. 5*a* is designed for use with a handgun in the nature of a semi-automatic weapon, FIG. 5*b* is an embodiment in the configuration adapted for use with a handgun in the form of a revolver, with the upper edges of the clip member engaging a forward portion of the gun barrel.

In FIG. 5*a*, it will be noted that the sides 26 and 28 of the clip member 24 tightly engage the forward frame member of the automatic, with a pair of inwardly directed protuberances 36 and 38 being used in order to help assure a carefully aligned relationship between the frame of a semi-automatic type of handgun, and the structural member 10. As will be noted, the gun barrel 40 of the semi-automatic is typically somewhat above the rounded upper edges 32 and 34.

Figure 6A:
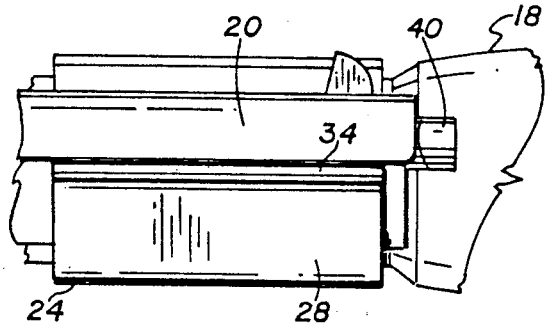
FIG. 6*a* is a side view of the device shown in FIG. 5*a*, revealing how the center of the barrel of the semi-automatic may be slightly above the center of the flashlight used therewith.

FIG. 6*a* is a side view of the structural member shown in FIG. 5*a*, with FIG. 6*a* revealing that the gun barrel 40 is somewhat above the centerline of the flashlight to be inserted into the tubular member, as shown in FIG. 5*a*. In FIG. 6*a*, portions of the flashlight 18 are visible.

Figure 6B:
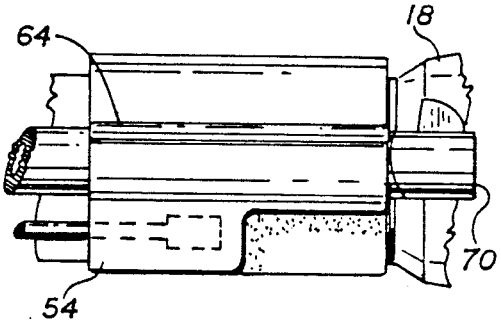
FIG. 6*b* is a view generally comparable to FIG. 6*a*, but here showing the center of the barrel of the revolver being more or less coincident heightwise with the center of the flashlight used therewith.

In FIG. 5*b*, the upper edges 62 and 64 of the clip member 54 are revealed to be configured to readily permit the entry of the outer portion of the gun barrel 70, which of course entails the resilient sidewalls 56 and 58 of the clip member 54 being configured to tightly grasp an elongate item of circular cross-section. FIG. 6*b* reveals the manner in which the barrel 70 resides essentially in coincidence with the centerline of the flashlight 18.

Figure 7:
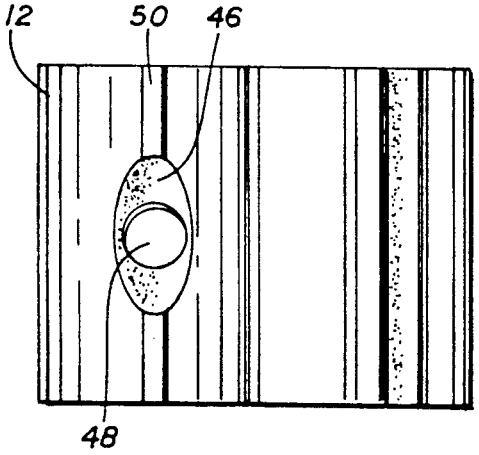
FIG. 7 is a view showing how the flashlight-receiving portion of my Night Shooting Aid is configured to enable the user to readily manipulate the on/off switch of the flashlight.

FIG. 7 reveals how an upper portion of the flashlight engaging member 12 is cut away to give the user ready access to the elongate on/off switch associated with the flashlight 18.

In other words, a declivity 46 as well as a central hole 48 are provided at a location approximately half way back from the forward edge of the flashlight-engaging member 12. Although not shown, a declivity is also formed in the interior of the flashlight-engaging member 12 adjacent the hole 48, with this serving the purpose of enabling the user , during the flashlight-insertion procedure, to quickly find the location at which the switch of the flashlight is to reside in the flashlight-engaging member. In a manner of speaking, the relationship of the declivity and hole on the one hand, and the on/off switch for the flashlight on the other hand, is such that a line up of the switch with the hole 48 in the declivity can be readily attained.

To further enable the user to readily achieve an alignment between the on/off switch on the flashlight, and the flashlight-receiving hole 48 of the member 12, one of the ribs, rib 50, is placed in alignment with the control hole 48; note FIGS. 1, 5*a* and 7.

Figure 8:
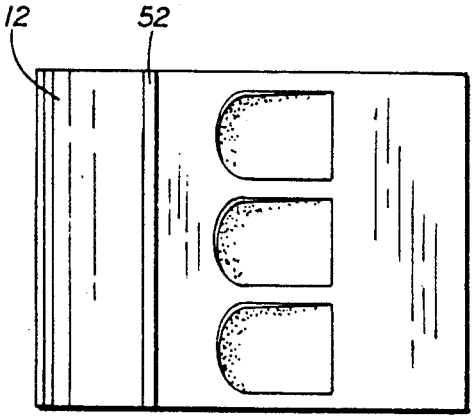
FIG. 8 is a view of the underside of a preferred embodiment of my Night Shooting Aid, indicating how finger-receiving indentations may be utilized therein.

FIG. 8 reveals a typical underside of the structural member 10, with indentations on the side of the structural member opposite the upper side of the clip member 24 (or clip member 54) being spaced to receive the fingers of the typical user, thus to obtain additional stability.

As previously mentioned, a typical manner of use of my Night Shooting Aid is revealed in FIG. 2, with the user quite obviously being in the two-handed stance that has been found most accurate and effective in the various police departments that are from time to time called upon to engage in firefights with felons. As shown in FIG. 2, the handgun may be held in the right hand of the user, with the left hand of the user grasping the flashlight in the vicinity of the switch of the flashlight. As a result of this arrangement, the user may switch the light on and off readily, should such be warranted.

With reference to FIG. 3, it will there be seen that the user of my device is not compelled to grasp the handle of the handgun with his right hand. Rather, FIG. 3 reveals that the user may grasp the handgun 20 with his left hand, with part of the weight of the flashlight barrel being supported in the general area of the left wrist.

As indicated hereinbefore, the structural device 10 forming the most basic portion of this invention readily lends itself to a use in which the law officer carries the flashlight unencumbered by the weapon, but with the open sides of the resilient clip member generically described as clip C extending upwardly in a position to receive the weapon should the occasion arise.

One of the important aspects of my invention is the ability it gives the user of being able to quickly insert the forward portion of the weapon between the resilient sidewalls 26 and 28 of the clip member 24, or the resilient sidewalls 56 and 58 of the clip member 54, should the user suddenly become aware in a condition of low visibility, that he may be in a firefight situation. As previously mentioned, the rounded upper edges 32 and 34 of the clip member 24, and the rounded upper edges 62 and 64 of the clip member 54, facilitate the insertion of the handgun into the respective clip member.

The construction and arrangement of my device is such that the user can be assured that the weapon will be received and tightly held in the elongate clip member 24 or 54 in an accurate and highly desirable relationship to the beam of the flashlight 18, so that the law officer can quickly have the advantage of being able to get off the first accurate shot, before the felon has had the opportunity to fire.

As previously mentioned, in FIG. 4 I reveal that I prefer for the alignment of the clip 14 serving as the handgun-receiving member to be such that a bullet fired from the barrel of the gun will coincide with the flashlight beam at a desired distance forward of the lens of the flashlight. This distance may be from twelve feet to eighteen feet, and as previously mentioned, coincidence at fifteen feet is typically preferred.

With regard now to other aspects of my invention, I prefer, but do not require, that my weapon holder be made of a tough, strong material such as DEXTRON 100. By suggesting this I do not intend to connote that other materials cannot be used, such as other strong, tough plastics, or certain relatively light metals.

It will be noted in FIGS. 1 and 5*a* that I prefer to utilize four equally spaced ribs 50, 51, 52 and 53 on the outer portion of component 12, with these ribs serving the purpose of providing the user a better grip, and in assuring extra strength to the flashlight-engaging portion. Another important reason for these four external ribs is that they serve as a form of mold release, and also provide the user a guide in focusing the beam of the flashlight.

I preferably have top rib 50 in alignment with the hole or aperture 48 through which the on/off switch is to be accessible, as previously mentioned, this being provided in order to simplify the insertion of the flashlight into the holder in the most appropriate orientation. Furthermore, a spot or an indicator 60 may be placed upon the forwardmost portion of the flashlight, which portion is rotated to achieve the best focus. The spot or indicator 60 is placed so as to bear a relationship to the forward portion of the rib 50, which rib serves as a reference point during the focusing of the beam from the flashlight.

It is also preferable to provide a longitudinal slit 72 under at least one of the external ribs of my device, this elongate longitudinal slit serving as an expansion joint.

It is also to be noted in FIGS. 1 and 5*a* that I may utilize a plurality of internal ribs 74 extending the length of my weapon holder, which are of some assistance in increasing the strength and non-crush aspects of my device, but more importantly, these internal ribs 74 tend to inhibit any tendency of the flashlight 18 to undesirably rotate in the cylindrically shaped aperture 22. As is obvious, should the flashlight rotate for a significant amount, this might well take the on/off switch a substantial distance away from the hole or aperture 48 through which the on/off switch is normally operated.

I claim:

1. A night shooting aid providing the user with the ability to shoot accurately in an environment of low natural light, and permitting the user, at his or her option, to use a two handed stance in holding a hand weapon equipped with a barrel, said shooting aid comprising a structural device having opposed, spaced-apart lateral edges, with a flashlight-engaging member provided along one edge, and a weapon-retaining member provided along the opposite edge, thus to enable a flashlight and a hand weapon to be supported in a generally parallel but spaced-apart relationship by said structural device, with the flashlight and the hand weapon thus being readily able to be aimed in a common direction, said weapon-retaining member being of resilient material and designed to receive and tightly engage a forward portion of the weapon, at a location below the barrel, the user being quickly able to insert a handgun into said weapon-retaining member when commencing an activity at low light level possibly leading to a shootout.

2. The night shooting aid providing the user with the ability to shoot accurately in an environment of low natural light as recited in claim 1 in which said structural device is made of metal.

3. The night shooting aid providing the user with the ability to shoot accurately in an environment of low natural light as recited in claim 1 in which said structural device is made of plastic.

4. The night shooting aid providing the user with the ability to shoot accurately in an environment of low natural light as recited in claim 1 in which the aim point of the flashlight is set to coincide with the aim point of the weapon at a distance in the range of twelve to eighteen feet in front of the user.

5. A night shooting aid providing the user with the ability to shoot accurately in an environment of low natural light, said shooting aid comprising a structural device having opposed, spaced apart lateral edges, with a flashlight-engaging member along one edge, and a weapon-retaining member along the opposite edge, thus to enable a flashlight and a weapon supported by said structural device to be aimed in a common direction, said flashlight-engaging member being of generally tubular configuration, and having an inner diameter only slightly larger than the outer diameter of a flashlight to be used with said structural device, said weapon-retaining member taking the form of an elongate clip member whose lowermost portion is supported from said opposite edge of said structural device and having its uppermost edge upward, with said clip member being of resilient material and designed to receive and tightly engage a forward portion of the weapon, said structural device being able to be maintained with a flashlight inserted into said flashlight-engaging member of generally tubular configuration, with the user being able to quickly insert a handgun into said weapon-retaining member when commencing an activity at low light level possibly leading to a shootout.

6. The night shooting aid providing the user with the ability to shoot accurately in an environment of low natural light as recited in claim 5 in which said structural device is made of metal.

7. The night shooting aid providing the user with the ability to shoot accurately in an environment of low natural light as recited in claim 5 in which said structural device is made of plastic.

8. The night shooting aid as recited in claim 5 in which said elongate clip member has sidewalls configured to receive a semi-automatic handgun.

9. The night shooting aid as recited in claim 5 in which said elongate clip member has sidewalls configured to receive a revolver.

10. The night shooting aid as recited in claim 5 in which the aim point of the flashlight is set to coincide with the aim point of the weapon at a distance in the range of twelve to eighteen feet.

11. A night shooting aid enabling the user to confirm the presence of a felon at night before pulling the trigger of a hand weapon, comprising a mounting device configured to receive a flashlight as well as a hand weapon, said mounting device having opposed, spaced apart lateral edges, with a flashlight-receiving portion on one edge, and a weapon-receiving clip on the opposite edge, both disposed to point in a common direction, said flashlight-receiving portion being in the form of a generally cylindrically shaped member having an inner diameter only slightly larger than the flashlight to be received therein, said weapon-receiving clip being supported from its lowermost portion from said opposite edge of said mounting device and laterally spaced from said flashlight-receiving portion and having upwardly extending sidewalls that are closer together at the top than at the bottom, said clip being of a resilient material such that its sidewalls resist separation, said clip sidewalls, upon being forced apart to receive a forward portion of a weapon therein, serving to tightly grip the weapon, and to direct the aim of the weapon to a point of coincidence with the aim of the flashlight.

12. The night shooting aid as recited in claim 11 in which said sidewalls of said weapon-receiving clip are configured to receive a semi-automatic handgun.

13. The night shooting aid as recited in claim 11 in which said sidewalls of said weapon-receiving clip are configured to receive an revolver.

14. The night shooting aid as recited in claim 11 in which said structural device is made of metal.

15. The night shooting aid as recited in claim 11 in which said structural device is made of plastic.

16. The night shooting aid as recited in claim 11 in which the aim point of the flashlight is set to coincide with the aim point of the weapon at a distance in the range of twelve to eighteen feet.

* * * * *